US005170342A

United States Patent [19]

Nakamura et al.

[11] Patent Number: 5,170,342

[45] Date of Patent: Dec. 8, 1992

[54] METHOD AND APPARATUS FOR AUTOMATING A ROUTINE OPERATION OF ELECTRONICALLY CONTROLLED HYDRAULIC-POWERED MACHINE

[75] Inventors: Kentaro Nakamura; Kiyoshi Note; Koichi Yamashita; Shinji Maeda, all of Hiratsuka, Japan

[73] Assignee: Kabushiki Kaisha Komatsu Seisakusho, Tokyo, Japan

[21] Appl. No.: 548,880

[22] PCT Filed: Nov. 22, 1989

[86] PCT No.: PCT/JP89/01195

§ 371 Date: Sep. 18, 1990

§ 102(e) Date: Sep. 18, 1990

[87] PCT Pub. No.: WO90/05816

PCT Pub. Date: May 31, 1990

[30] Foreign Application Priority Data

Nov. 22, 1988 [JP] Japan ..... 63-295334
Nov. 26, 1988 [JP] Japan ..... 63-325963

[51] Int. Cl.[5] ..... G06F 15/20

[52] U.S. Cl. ..... 364/167.01; 37/DIG. 1; 364/180; 364/193; 364/424.07

[58] Field of Search ..... 364/142, 167.01, 424.07, 364/567, 180, 160, 193; 56/10.2, DIG. 15; 172/2, 4, 4.5; 37/DIG. 1

[56] References Cited

U.S. PATENT DOCUMENTS 4,627,013 12/1986 Ichiyama et al. ..... 364/567
4,699,239 10/1987 Ishino et al. ..... 364/424.07 X
4,715,012 12/1987 Mueller, Jr. ..... 364/424.07 X
4,742,468 5/1988 Ohashi et al. ..... 364/424.07
4,949,263 8/1990 Nrca ..... 364/424.07

FOREIGN PATENT DOCUMENTS 59-195938 11/1984 Japan .

*Primary Examiner*—Joseph Ruggiero
*Attorney, Agent, or Firm*—Armstrong & Kubovcik

[57] ABSTRACT

A method and apparatus for automating a routine operation of an electronically controlled hydraulic-powered machine is provided. The apparatus is mounted on the hydraulic-powered machine to have the hydraulic-powered machine automatically and repetitively perform its simple routine operation. The present invention also provides a method and apparatus for automating a routine operation of an electronically controlled hydraulic-powered machine to perform an effective loading operation of a present amount of load.

3 Claims, 8 Drawing Sheets

METHOD AND APPARATUS FOR AUTOMATING A ROUTINE OPERATION OF ELECTRONICALLY CONTROLLED HYDRAULIC-POWERED MACHINE

FIELD OF THE INVENTION

The present invention relates to a method and apparatus for automating a routine operation of an electronically controlled hydraulic-powered machine, the apparatus being mounted on the hydraulic-powered machine such as construction machines and the like to have the hydraulic-powered machine respectively perform its simple routine operation automatically, which routine operation is frequently required to be performed in practice.

DESCRIPTION OF THE PRIOR ART

As for a control system of a hydraulic-powered machine such as construction machines and the like comprising power shovels and wheel-type loaders, further advances in electronic engineering and hydraulic engineering in recent years make it possible to replace a conventional mechanical control system of the hydraulic-powered machine with an electronically controlled system in which a control leverl 1 of the machine is moved by an operator of the machine in operation to the extent of a desired amount as shown in FIG. 1, so that the desired amount of motion of the control lever 1 is converted into an electric signal on the basis of which the hydraulic-powered machine is controlled. Namely, as shown in FIG. 1, in an electric control unit 2, the desired amount of motion of the control lever 1 operated by the operated is converted into the electric signal which is issued from the electric control unit 2 to an electronic controller 3. Then, in the electronic controller 3, the electric signal is converted into another signal issued to an electronically controlled hydraulic valve 4. Consequently, in response to the another signal, the electronically controlled hydraulic valve 4 permits a hydraulic pump 6 to supply a predetermined amount of pressure oil to a hydraulic actuator 5 through passages *7a* or *7b*, which amount of pressure oil corresponds to another signal.

Such a conventional electronically controlled system having the above construction permits the operator of the hydraulic-powered machine to conduct a delicate operation of the machine, which delicate operation can not be performed hitherto.

As described above, the conventional electronically controlled system shown in FIG. 1 permits the operator of the hydraulic-powered machine to perform, a delicate operation. However, in this conventional system, operation of the hydraulic-powered machine is manually conducted by the operator of the machine through the manually controlled lever 1. Particularly, for example, in a digging operation of a wheel-type hydraulic-powered loader H, as shown in FIG. 2A, first of all, the loader is moved forward in a condition in which a bucket B of the loader H is oriented toward a pile of earth E, so that the bucket B penetrates the pile of earth E. After that, the bucket B is gradually moved to have its opening oriented upward as the loader H moves further forward. Namely, the bucket B is filled with earth E by upward and forward motion. Then, as shown in FIG. 2B, the loader H travel to a desired place. When the loader H reaches the desired place, the opening of the bucket B is oriented downward to unload the earth E onto the place as shown in FIG. 2C. After that, the loader H is moved slightly rearward to complete its digging operation.

As described above, in the conventional earth digging operation conducted by the wheel-type hydraulic-powered loader H, several tens of repetitive routine operations, i.e., repetitive earth digging and unloading operations are required. Therefore, the operator of the loader H is overburdened with such a tiresome repetition of the same operations.

SUMMARY OF THE INVENTION

Under such circumstances, the present invention was made. Consequently, it is an object of the present invention to provide a method and apparatus for automating a routine operation of an electronically controlled hydraulic-powered machine, the apparatus being mounted on the hydraulic-powered machine to have the hydraulic-powered machine perform repetitively its simple routine operation by automation in safety, which routine operation is frequently required to be performed.

It is another object of the present invention to provide a method and apparatus for automating a routine operation of an electronically controlled hydraulic-powered machine, the apparatus being mounted on the hydraulic-powered machine to have the hydraulic-powered machine perform an effective loading operation of a present amount of load.

In accordance with a first aspect of the present invention, the above objects of the present invention are accomplished by providing:

In a method for automating a routine operation of an electronically controlled hydraulic-powered machine in which a motion of a control lever operated by an operator is converted into an electric signal which is issued to an electronic controller which in turn issues a control signal on the basis of the electric signal to control the hydraulic-powered machine, the improvements which comprises:

issuing a first signal for causing a working equipment mounted on the hydraulic-powered machine to perform a routine operation corresponding to a specific motion of the control lever operated by the operator;

summing in calculation the first signal and a mode signal in an operation automating controller after the first signal and the mode signal are received by the operation automating controller, the mode signal being issued from a switchboard to the operation automating controller for determining a mode of the routine operation; and issuing an electric signal from the operation automating controller to the electronic controller.

In accordance with a second aspect of the present invention, the objects of the present invention are accomplished by providing:

In a method for automating a routine operation of an electronically controlled hydraulic-powered machine in which a motion of a control lever operated by an operator is converted into an electric signal which is issued to an electronic controller which in turn issues a control signal on the basis of the electric signal to control the hydraulic-powered machine, the improvements which comprises:

issuing a first signal for causing a working equipment mounted on the hydraulic-powered machine to perform a routine operation corresponding to a specific motion of the control lever operated by the operator;

summing in calculation the first signal, a preset data signal and sensor data signal in an operation automating controller which issues a resultant data, the preset data signal being issued from a switchboard for previously selectively determining a target workload, and the sensor data signal being issued from a sensor mounted on the working equipment for measuring a weight of a load such as earth and the like with which the working equipment is loaded;

comparing the resultant data with a predetermined data;

issuing a playback signal until the resultant data coincides with the predetermined data, to cause the working equipment to repetitively perform the routine operation by automation; and stopping issuance of the playback signal when the resultant data coincides with the predetermined data, to cause the working equipment to stop the routine operation thereof.

In accordance with a third aspect of the present invention, the objects of the present invention are accomplished by providing:

In an apparatus for automating a routine operation of an electronically controlled hydraulic-powered machine in which a motion of a control lever operated by an operator of the hydraulic-powered machine is converted into an electric signal which is issued to an electronic controller which in turn issues a control signal on the basis of the electric signal to control the hydraulic-powered machine, wherein, the improvement comprises the apparatus further including:

a control lever signal issuing means for issuing a control level signal which causes a working equipment mounted on the hydraulic-powered machine to perform a routine operation corresponding to a specific motion of the control lever operated by the operator;

a switchboard for selectively determining a mode of the routine operation to issue a mode signal; and an operation automating controller for receiving the control level signal and the mode signal to sum these signals in calculation to issue a resultant electric signal to the electric controller.

In accordance with a fourth aspect of the present invention, the objects of the present invention are accomplished by providing:

In the apparatus for automating the routine operation of the electronically controlled hydraulic-powered machine, as set forth in the third aspect, wherein:

the apparatus further comprises a sensor for measuring a weight of a load such as earth and the like with which the working equipment mounted on the hydraulic-powered machine is loaded, the sensor being mounted on the working equipment to issue a loading weight data signal to the operation automating controller, which loading weight data signal corresponds to a loading weight of the working equipment.

In accordance with a fifth aspect of the present invention, the objects of the present invention are accomplished by providing:

In the apparatus for automating the routine operation of the electronically controlled hydraulic-powered machine, as set forth in the third or fourth aspect, wherein the operation automating controller comprises:

a memory means for storing the control lever signal providing an instruction value;

an operation-range displaying unit for displaying an operation range of the working equipment;

a preset cycle time displaying unit for displaying a preset cycle time of the instruction value;

a residual time displaying unit for displaying a residual time or residual memory area in the memory means;

a warning unit for giving a warning before the specified routine operation starts; and a played-back operation number displaying unit for displaying the number of the routine operations having been repetitively played back.

Effects of the present invention having the above aspects are as follows:

(1) Only by operating the control lever and depressing an operation-mode button of the switchboard, it is possible for the operator to have the working equipment of the hydraulic-powered machine perform repetitively the frequently required simple routine operation by automation. Consequently, the present invention can releases the operator from a tiresome repetition of work;

(2) The present invention makes it possible to accurately sum the loading weight of the load such as earth and the like with which the working equipment is loaded. Consequently, the present invention can eliminates variation in loading weight due to operator's factor or personal factor to realize an effective loading operation with respect to a predetermined load;

(3) According to the present invention, it is possible for the second operator to previously know the routine operation of the working equipment when he playbacks the motion of the control lever having been stored by the first operator, it is possible for the second operator to have the working equipment playback repetitively the routine operation in safety;

(4) According to the present invention, since the operator can confirm the cycle time of the routine operation and also easily measures the cycle time of another routine operation, it is possible for the operator to easily conduct the operating control of the working equipment;

(5) According to the present invention, since the operator can confirm the residual time stored in the memory means, there is no fear that the residual time expires during a storage operation of the memory means. Consequently, it is possible to prevent error in storage operation from occurring;

(6) In case that the operator has the working equipment playback the routine operation thereof, the operator knows the following action of the working equipment. Consequently, in case that the following action of the working equipment is dangerous to the other workers around the hydraulic-powered machine on which the working equipment is mounted, it is possible for the operator to preset the warning switch so as to give a warning to the other workers several seconds earlier than before the working equipment starts the following dangerous action, so that the present invention prevents accidents from occurring; and (7) According to the present invention, it is possible for the operator to confirm the number of the routine operation having been repetitively played back. Consequently, by confirming a weight of the load with which a bucket of the working equipment is loaded, it is possible for the operator to estimate a total amount of workload having been done during the routine operation repetitively played back.

The above objects, additional objects, additional embodiments and advantages of the present invention will be clarified to those skilled in the art hereinbelow with reference to the following description and accompanying drawings illustrating preferred embodiments of the present invention according to principles of the present invention.

DESCRIPTION OF THE PREFERRED EMBODIMENTS

Hereinbelow, preferred embodiments of the present invention will be described in detail with reference to the accompanying drawings (FIGS. 3 to 9).

Figure 1:
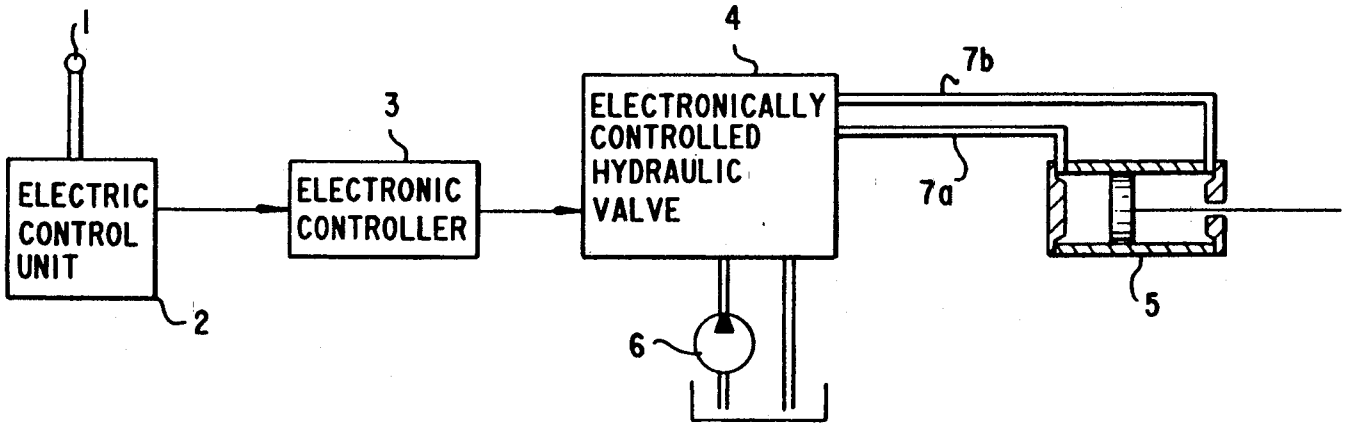
FIG. 1 PRIOR ART
FIG. 1 is a schematic block diagram of a conventional apparatus for automating a routine operation of the electronically controlled hydraulic-powered machine.
Figure 2A:
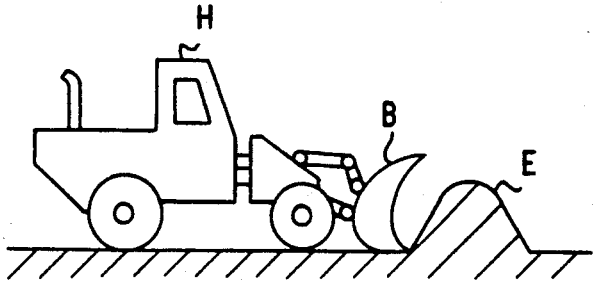
FIG.2A PRIOR ART
FIGS. 2A, 2B and 2C are schematic side views of the wheel-type hydraulic-powered loader, illustrating earth loading/unloading operation of the loader.
Figure 2B:
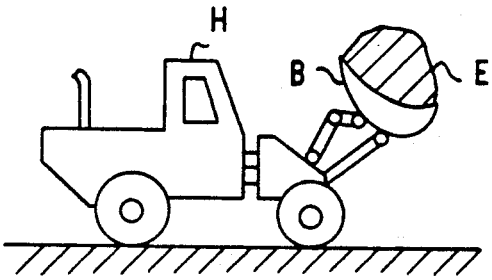
FIG.2B PRIOR ART
Figure 2C:
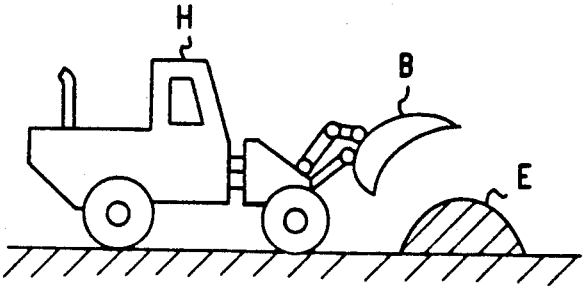
FIG.2C PRIOR ART
Figure 3:
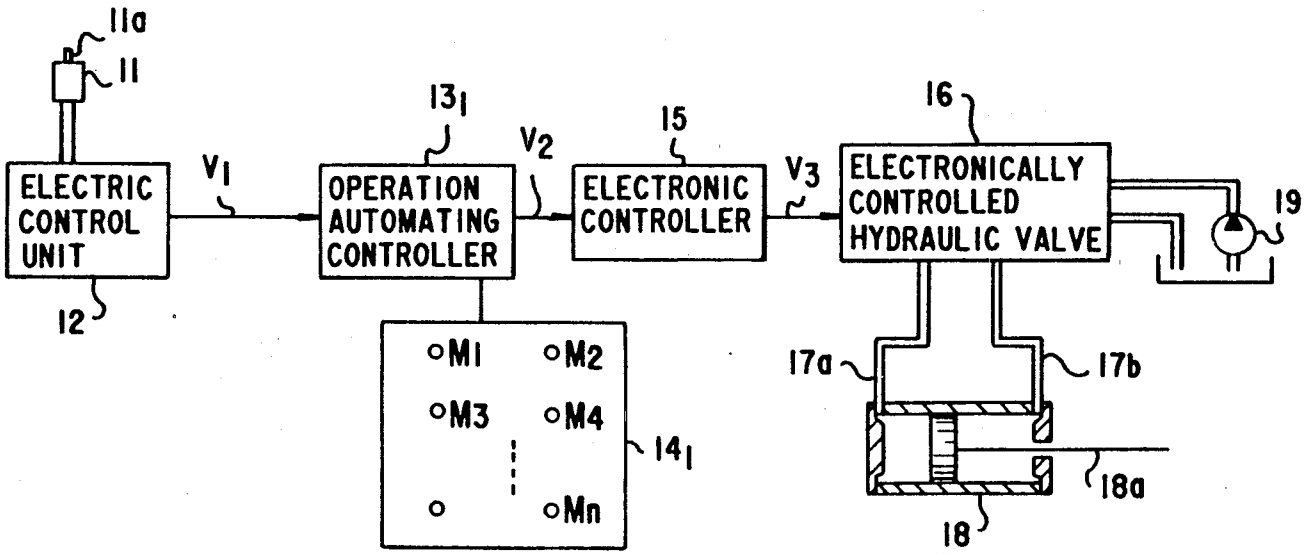
FIG. 3 is a schematic block diagram of a first embodiment of an apparatus of the present invention for automating a routine operation of an electronically controlled hydraulic-powered machine.
Figure 4:
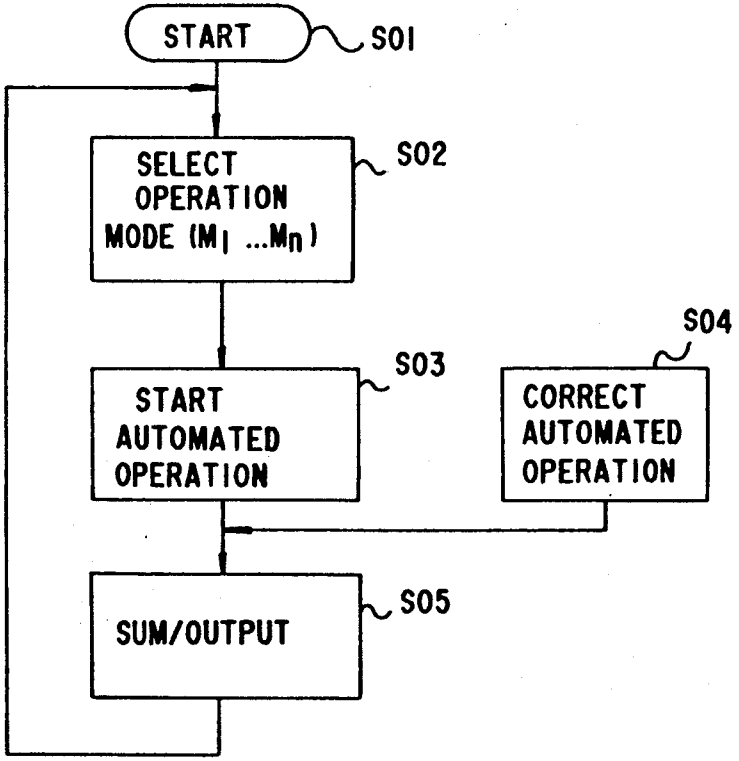
FIG. 4 is a flowchart of the operation performed by the first embodiment of the present invention shown in FIG. 3.

FIG. 3 is a schematic block diagram of a first embodiment of an apparatus of the present invention for automating a routine operation of an electronically controlled hydraulic-powered machine. A flowchart of operation performed by the first embodiment of the apparatus of the present invention shown in FIG. 3 is shown in FIG. 4.

In the drawings: the reference numeral 11 denotes a control lever of a working equipment, for example such as that shown in FIG. 3, the working equipment being mounted on the hydraulic-powered machine; and 12 an electric control unit for converting a motion of the control lever 11 operated by an operator into an electric signal $V_1$ which is issued from the electric control unit 12 to an operation automating controller $\mathbf{13}_1$. The controller $\mathbf{13}_1$ issues a signal $V_2$ to an electronic controller 15 upon receipt of the electric signal $V_1$. In accordance with the signal $V_2$ issued from the operation automating controller $\mathbf{13}_1$, the electronic controller 15 issues an electric signal $V_3$ for controlling an electronically controlled hydraulic valve 16. Through the thus controlled hydraulic valve 16, pressure oil supplied by a hydraulic pump 19 passes through passage 17*a* or 17*b* so as to be supplied to a hydraulic actuator 18 such as hydraulic motors and hydraulic cylinders, whereby an actuating rod 18*a* of the hydraulic actuator 18 is actuated.

In the drawings, the reference numeral $\mathbf{14}_1$ denotes a switchboard for selectively determining a mode $M_1$, $M_2$, $M_3$, . . . , $M_n$ of the automated routine operation of the working equipment mounted on the hydraulic-powered machine.

In operation, the operator of the working equipment selects a mode of the automated routine operation of the working equipment by pushing a push button of the switchboard $\mathbf{14}_1$ so that the switchboard issues a signal for having the working equipment perform a desired frequently-required routine operation, for example such as a digging operation when the push button for the mode $M_1$ is pushed or a earth discharging operation when the push button for the mode $M_2$ is pushed. Under such circumstances, when the operator pushes a push button 11*a* of the control lever 11, the working equipment start the routine operation automatically, the routine operation being specified by pushing the push button of the switchboard $\mathbf{14}_1$.

In case that the automatic routine operation performed by the working equipment must be corrected, it is necessary for the operator to operate the control lever 11 of the working equipment. When the operator operates the control lever 11 of the working equipment in operation, the electric control unit 12 issues an electric signal to be summed in calculation.

Now, operation of the apparatus of the present invention for automating the routine operation of the working equipment of the hydraulic-powered machine will be described with reference to a flowchart shown in FIG. 4.

The flowchart shown in FIG. 4 comprises steps SO1, SO2, SO3, SO4 and SO5. In the step SO1, operation of the working equipment starts. Then, in the step SO2, the operator pushes a desired one of the push buttons or mode buttons $M_1$, $M_2$, $M_3$, . . . , $M_n$ of the switchboard $\mathbf{14}_1$ to select a desired mode of the routine operation. After that, in the step SO3, the operator pushes a push button 11*a* of the control lever 11 of the working equipment to have the working equipment automatically perform the routine operation. In the step SO4, in order to correct the automated routine operation performed by the working equipment, the operator suitably operates the control lever 11 of the working equipment to have the electric control unit 12 issue an electric signal which is added to an automating signal in the step SO5, which automating signal has the working equipment automatically perform the routine operation.

Now, a second embodiment of the apparatus of the present invention for automating the routine operation of the working equipment will be described with reference to FIGS. 5 and 6. Incidentally, like reference numerals apply to similar parts through the first and the second embodiment of the present invention to avoid redundant description.

Figure 5:
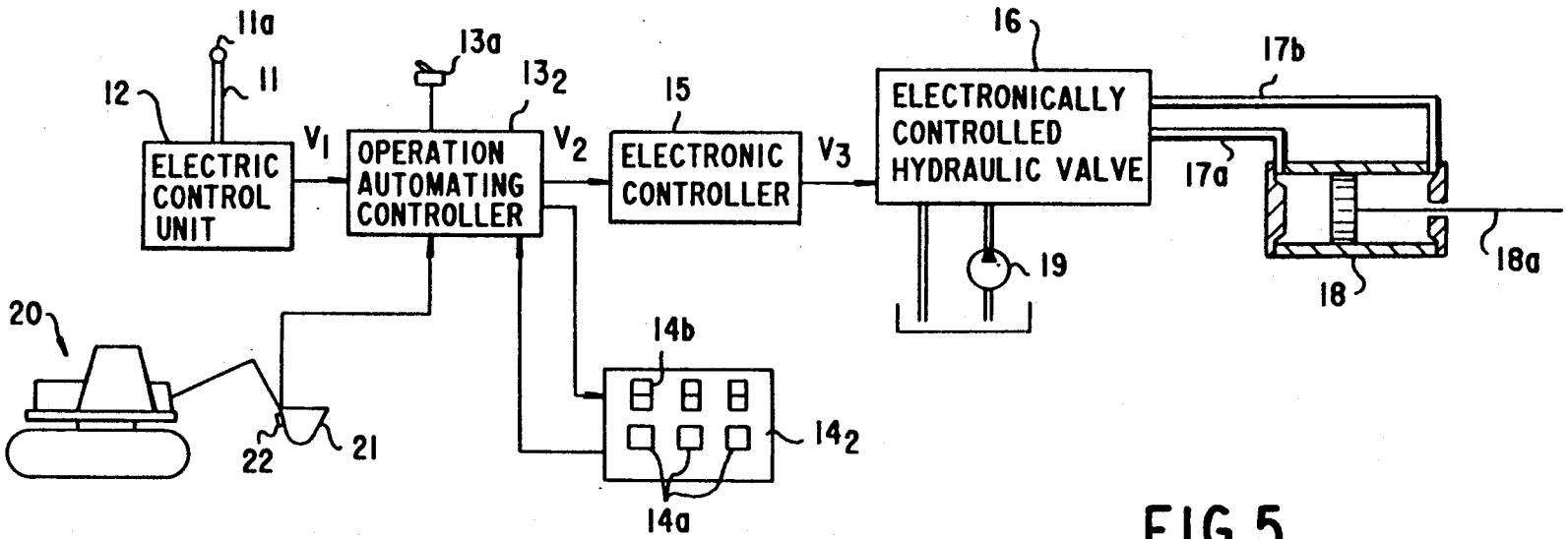
FIG. 5 is a schematic block diagram of a second embodiment of the apparatus of the present invention for automating the routine operation of the electronically controlled hydraulic-powered machine.
Figure 6:
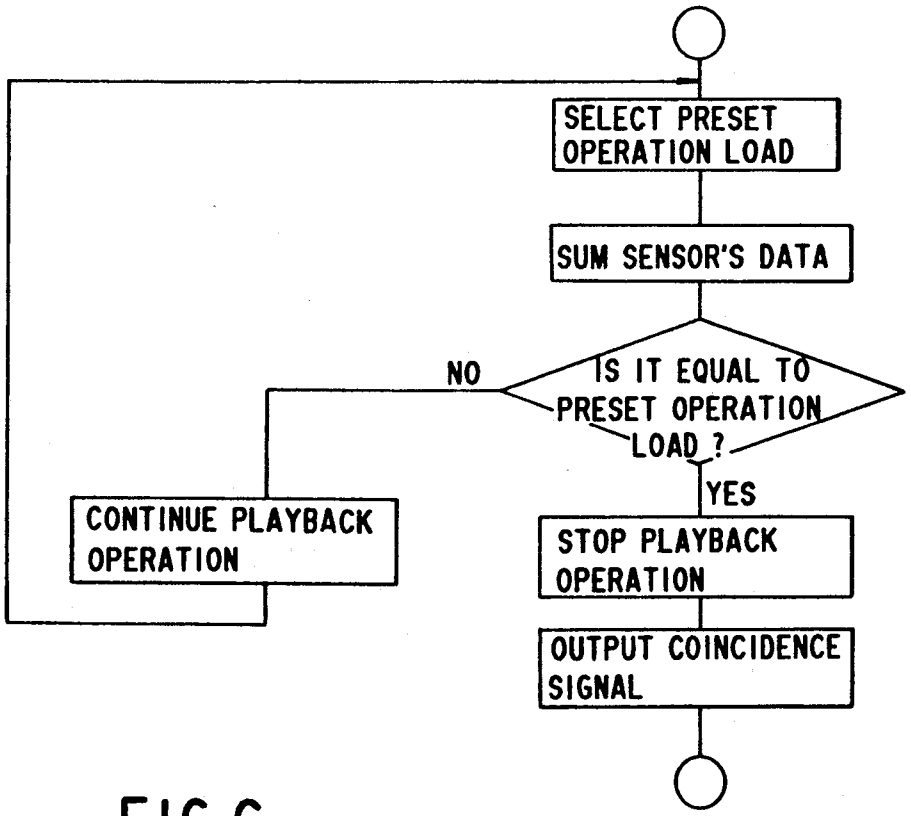
FIG. 6 is a flowchart of the operation performed by the second embodiment of the present invention shown in FIG. 5.

In FIG. 5: the reference numeral 20 denotes the working equipment, for example such as electronically controlled hydraulic-powered digging machines and the like; and 21 a bucket employed in the working equipment 20. The working equipment or digging machine 20 is controlled in operation by an electronic controlling system of the second embodiment of the present invention shown in FIG. 5. On the other hand, mounted on the bucket 21 of the working equipment or digging machine 20 is a sensor 22 for measuring a loading weight of a load with which the bucket 21 is loaded.

The second embodiment of the apparatus of the present invention shown in FIGS. 5 and 6 differs from the first embodiment of the present invention shown in FIGS. 3 and 4 in the following points:

Namely, in the second embodiment of the present invention, as shown in FIG. 5, the operation automating controller $\mathbf{13}_2$ is electrically connected with the switchboard $\mathbf{14}_2$ which is provided with a plurality of workload switch buttons 14*a* and a plurality of data processing display units 14*b*, through which workload switch buttons 14*a* a workload is preset. Consequently, when the operator of the working equipment or digging machine 20 pushes a desired one of the workload switch buttons 14*a*, the thus specified workload is stored in a data area of the operation automating controller $\mathbf{13}_2$. Further input to the operation automating controller $\mathbf{13}_2$ each cycle of the routine operation performed by the working equipment or digging machine 20 is an actual workload data signal issued from the sensor 22 mounted on the bucket 21 of the working equipment or digging machine 20. Such actual workload data is accumulated in the operation automating controller $\mathbf{13}_2$.

Namely, in the operation automating controller $\mathbf{13}_2$, the actual workload data signal issued from the sensor 22 each cycle of the routine operation performed by the working equipment or digging machine 20 is summed up to produce a summed data signal which is compared with the predetermined data signal. Until the summed data signal coincides in amount with the predetermined data signal, a playback signal is issued from the operation automating controller $\mathbf{13}_2$ to the electronic controller 15 to have the electronically controlled hydraulic valve 16 permit the hydraulic pump 19 to supply the pressure oil to the hydraulic actuator 18 through the passage 17*a* or 17*b*, so that the actuator 18 performs repetitively its actuating operation, whereby the routine operation of the working equipment or digging machine 20 is automatically repetitively performed.

In operation, when the summed data signal coincides in amount with the predetermined data signal, issuance of the playback signal stops to stop the repetitive routine operation of the working equipment or digging machine 20. At the same time, the display units 14*b* display a condition in which the summed data signal coincides in amount with the predetermined data signal. Incidentally, in FIG. 5, the reference numeral 13*a* denotes a starting switch of the operation automating controller $\mathbf{13}_2$.

The operation described above is shown in the flowchart shown in FIG. 6.

In accordance with the second embodiment of the apparatus of the present invention, it is possible for an unskilled operator to have the working equipment or digging machine 20 perform accurately and effectively the routine operation which is hitherto performed only by a skilled operator.

Figure 7:
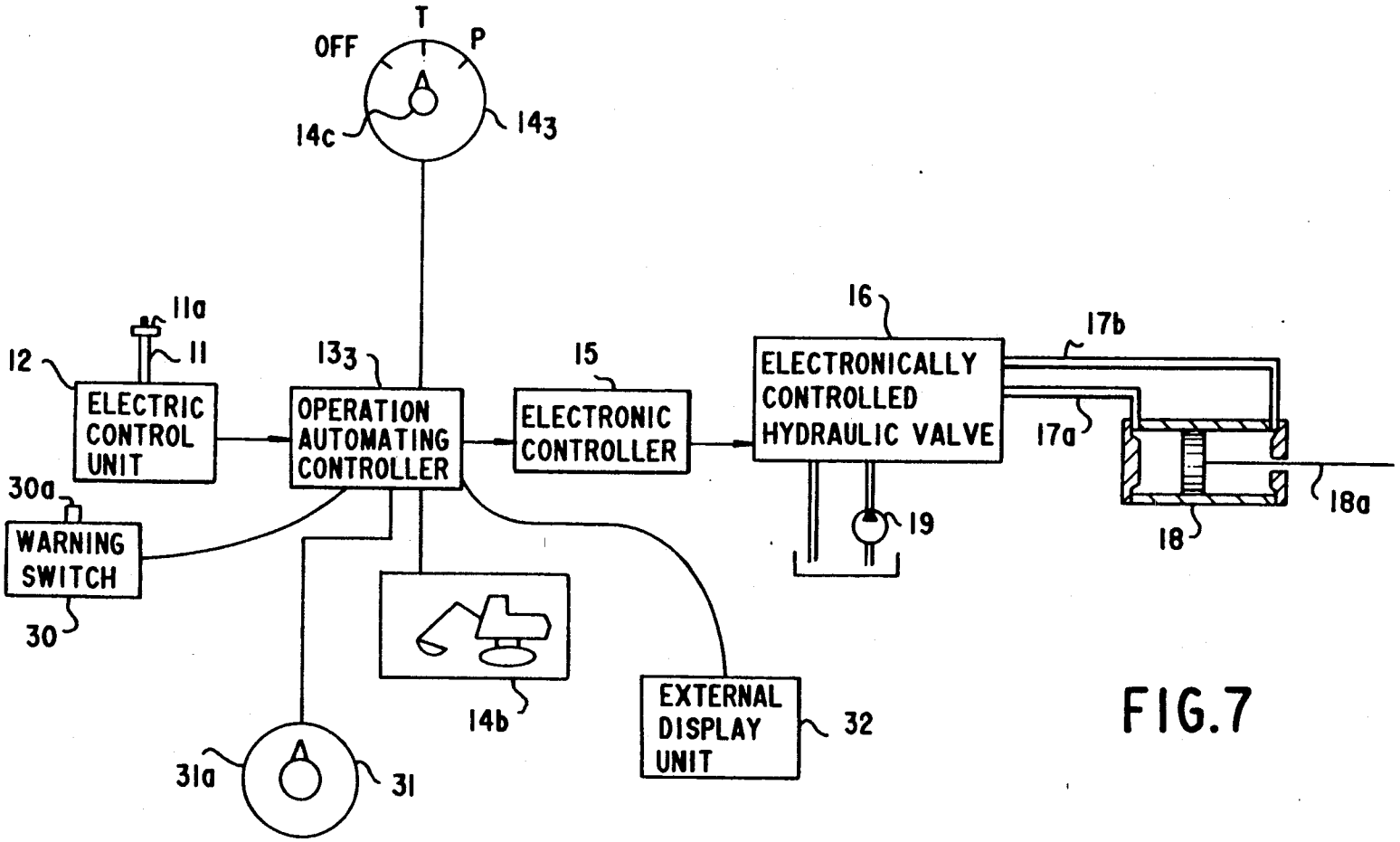
FIG. 7 is a schematic block diagram of a third embodiment of the apparatus of the present invention for. automating the routine operation of the electronically controlled hydraulic-powered machine.

FIG. 7 is a schematic block diagram of a third embodiment of the apparatus of the present invention for automating the routine operation of the electronically controlled hydraulic-powered machine.

The following should be considered in automating the routine operation which is frequently and repetitively required in practice: namely (1) When the routine operation stored in the memory means by an operator is played back by another operator, it is very dangerous to play back such a routine operation in a condition in which the another operator does not recognize the type of the routine operation performed in a condition in which the another operator does not recognize the type of the routine operation performed by the working equipment;

(2) It is necessary to measure the cycle time of the routine operation performed by the working operation;

(3) When an amount of processes of the routine operation to be stored in the memory means exceeds a capacity of the memory means, error occurs in storage operation of the apparatus of the present invention;

(4) When the routine operation performed by the working equipment is dangerous to the other workers, it is necessary for the operator of the working equipment to give a warning to the other workers before the routine operation is performed; and (5) It is necessary for the operator of the working equipment to know the number of the routine operation having been repetitively performed.

In view of the above considerations, the third embodiment of the apparatus of the present invention is provided. Incidentally, like reference numerals apply to similar parts throughout the first, second and also the third embodiment of the present invention to avoid redundant description.

The third embodiment of the present invention shown in FIGS. 7 and 8 differs from the first embodiment of the present invention shown in FIGS. 3 and 4 in the following points. In the third embodiment of the present invention shown in FIGS. 7 and 8, inputs to the operation automating controller $\mathbf{13}_3$ are: the electric signal $V_1$ issued from the electric control unit 12; a switchboard signal issued from a dial-type switchboard $\mathbf{14}_3$ provided with a dial $\mathbf{14}_c$; a warning signal issued from a warning switch 30; and a display switching panel signal issued from a dial-type display switching panel 31 provided with a dial 31*a*. In addition, as shown in FIG. 7, the third embodiment of the present invention is provided with an external display unit 32.

Figure 8:
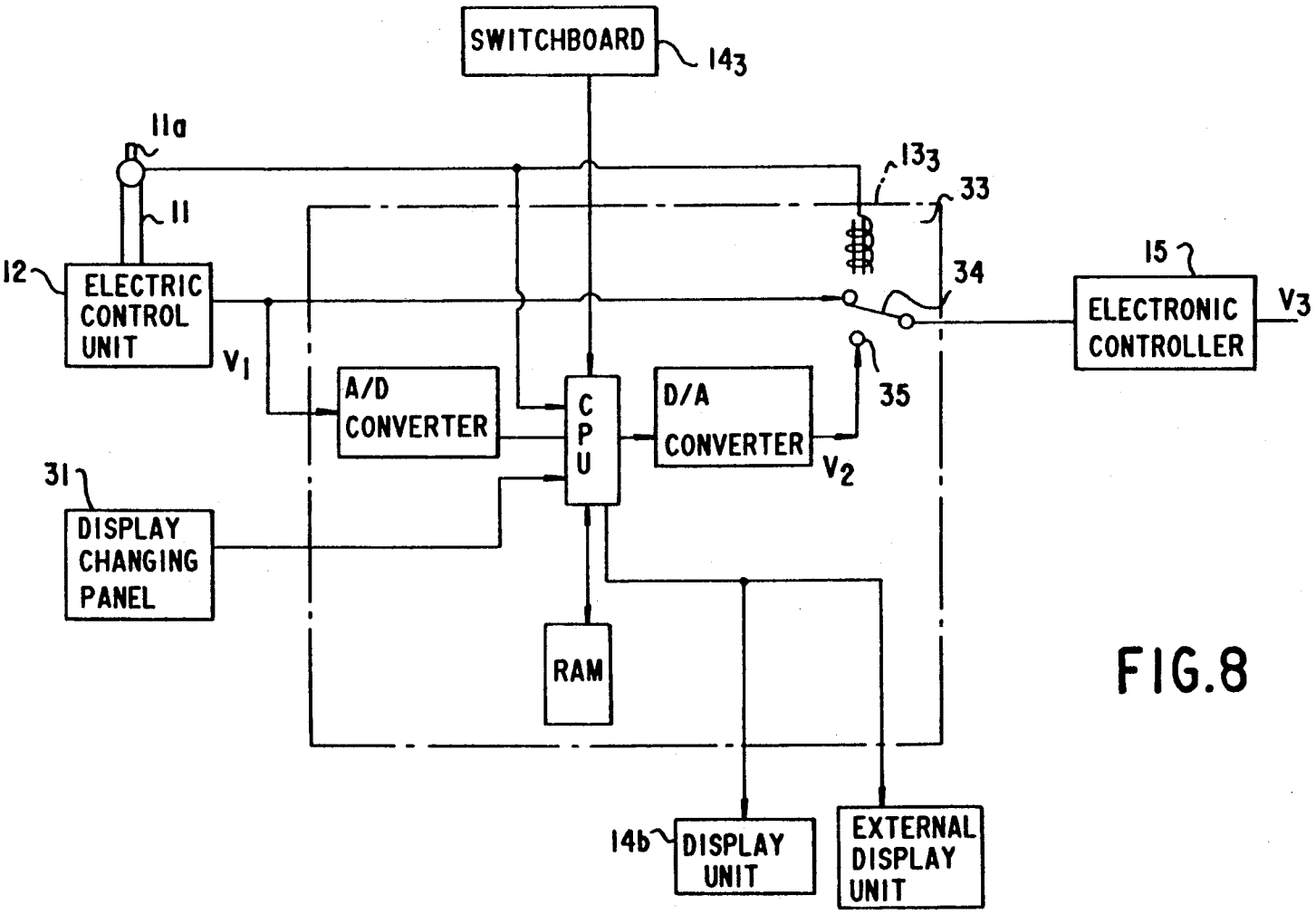
FIG. 8 is an electric circuit diagram of the operation automating controller employed in the third embodiment of the apparatus of the present invention.

FIG. 8 is an electric circuit diagram of the operation automating controller $\mathbf{13}_3$ employed in the third embodiment of the apparatus of the present invention, illustrating an internal construction of the operation automating controller $\mathbf{13}_3$.

In operation, when the operator sets the dial 14*c* of the switchboard $\mathbf{14}_3$ at a position T as shown in FIG. 7 and operates the control lever 11 of the working equipment, as shown in FIG. 8, the electric signal $V_1$ corresponding to a motion of the control lever 11 operated by the operator is issued from the electric control unit 12 to the operation automating controller $\mathbf{13}_3$ in which the electric signal $V_1$ is converted into a digital signal through an A/D converter. The thus converted digital signal is input to a CPU through which the digital signal is processed to produce a processed signal. The thus processed signal is then input to a D/A converter so as to be converted into an analog signal or electric signal $V_2$. At the same time, the processed signal is also stored in a RAM. On the other hand, the electric signal $V_2$ issued from the D/A converter is supplied to the electronic controller 15 which in turn issues another electric signal $V_3$ to control the electronically controlled hydraulic valve 16, so that the actuating rod 18*a* of the hydraulic actuator 18 is actuated as described above.

In the above operation, when the operator pushes the button 30*a* of the warning switch 30 in a condition in which the control lever 11 of the working equipment is operated by the operator, a warning issuance signal is stored in the operation automating controller $\mathbf{13}_3$.

Then, when the dial 31*a* of the display switching panel 31 is set at a position of "operation range" before the motion of the control lever 11 having been stored is played back, a motion of the working equipment is displayed in the display unit 9. In this case, if necessary, it is also possible for the display unit 9 to display the motion of the working equipment two times faster than original. On the other hand, when the dial 14*c* of the switch panel $\mathbf{14}_3$ is set at the position T, the motion of the control lever 11 of the working equipment is stored in the RAM of the operation automating controller $\mathbf{13}_3$ at predetermined time intervals. After that, the number of such storage operation performed in the RAM of the operation automating controller $\mathbf{13}_3$ is counted until the dial 14*c* reaches a position "off" or a position "P", so that the thus counted total number of the storage operation is multiplied by the predetermined time to obtain a product. Such product of the total number of the storage operation and the predetermined time constitutes a time a cycle or "cycle time" of the routine operation performed by the working equipment. Consequently, by setting the dial 31*a* of the display switching panel 31 at a position of the above "cycle time", it is possible for the operator to have the display unit 14*b* display the "cycle time".

After that, when the operator sets the dial 14*c* of the switchboard $\mathbf{14}_3$ at the position P and then pushes the push button 11*a* of the control lever 11 of the working equipment, a solenoid 33 of the operation automating controller $\mathbf{13}_3$ is electrically energized to cause a movable contact 34 to be brought into contact with a fixed contact 35. As a result, as shown in FIG. 8, the electric signal $V_1$ stored in the RAM of the operation automating controller $\mathbf{13}_3$ is processed in the CPU and then converted into the signal $V_2$ through the D/A converter, so that the signal $V_2$ is supplied to the electronic controller 15 through the contacts 34, 35. Consequently, the electronic controller 15 issues the electric signal $V_3$ to control the electronically controlled hydraulic valve 16, so that the actuating rod 18*a* of the hydraulic actuator 18 is actuated as described above.

In this case, the external display unit 32 gives a warning to the other workers around the working equipment before the operator pushes the button 30*a* of the warning switch 30.

On the other hand, in storage operation of another motion of the control lever 11 of the working equipment different from the motion of the lever 11 previously stored, in order to confirm a residual time or residual memory area of the RAM of the operation automating controller $\mathbf{13}_3$, the operator sets the dial 31*a* of the display switching panel 31 at a position of a "residual time". As a result, a memory area having been already used is subtracted from the total memory area of the RAM to give the residual memory area or residual time which is displayed in the display unit 14*b*. When the residual time or residual memory area of the RAM of the operation automating controller $\mathbf{13}_3$ reduces to a predetermined amount in operation, a warning is issued by reducing intervals in energizing time of intermittently lightened warning lamp or by giving a warning sound issued from buzzers and the like.

In addition, the operation automating controller $\mathbf{13}_3$ is provided with a counter for counting the number of the routine operation having been repetitively played back. In use, when the operator sets the dial 31*a* of the display switching panel 31 at a position of the "number of the routine operation having been played back", the number of the routine operation having been played back by the working equipment by automation is displayed in the display unit 14*b*. As a result, on the basis of a capacity of the bucket of the working equipment and the number of the routine operation displayed in the display unit 14*b*, it is possible for the operator to estimate the total workload accomplished by the working equipment by automation or played-back operation performed by the working equipment.

We claim:

1. A method for automating a routine operation of an electronically controlled hydraulic-powered machine in which a motion of a control lever operated by an operator is converted into an electric signal which is issued to an electronic controller which in turn issues a control signal based on said electric signal to control said hydraulic-powered machine, the method comprising the steps of:

issuing a first signal for causing a working equipment mounted on said hydraulic-powered machine to perform a routine operation corresponding to a specific motion of said control lever operated by the operator;

summing a) said first signal, b) a preset data signal and c) sensor data signal in an operation automating controller which issues a resultant data, said preset data signal being issued from a switchboard for previously selectively determining a target workload, and said sensor data signal being issued from a sensor mounted on said working equipment for measuring a weight of a load with which said working equipment is loaded;

comparing said resultant data with predetermined weight data;

issuing a playback signal to said working equipment to cause said working equipment to automatically repetitively perform the same routine operation from a beginning of said routine operation to an end of said routine operation until said resultant data coincides with said predetermined weight data; and stopping issuance of said playback signal when said resultant data coincides with said predetermined data, to cause said working equipment to stop said repeated performance of said same routine operation.

2. An apparatus for automating a routine operation of an electronically controlled hydraulic-powered machine in which a motion of a control lever operated by an operator of said hydraulic-powered machine is converted into an electric signal which is issued to an electronic controller which in turn issues a control signal based on said electric signal to control said hydraulic-powered machine, said apparatus comprising:

a control lever signal issuing means for issuing a control lever signal which causes a working equipment mounted on said hydraulic-powered machine to perform a routine operation corresponding to a specific motion of said control lever operated by the operator;

a switchboard for selectively determining a mode of said routine operation to issue a mode signal; and an operation automating controller for receiving said control lever signal and said mode signal, a sum of these signals output as a resultant electric signal to said electric controller to change said routine operation, wherein said operation automating controller including a memory means for storing said control lever signal providing an instruction value, an operation-range displaying unit for displaying an operation range of said working equipment, a preset cycle time displaying unit for displaying a preset cycle time of said instruction value, a residual time displaying unit for displaying a residual time or residual memory area in said memory means, a warning unit for giving a warning before said specified routine operation starts, and a played-back operation number displaying unit for displaying the number of said routine operations having repetitively played back.

3. The apparatus for automating said routine operation of said electronically controlled hydraulic-powered machine, as set forth in claim 2, further comprising a sensor for measuring a weight of a load with which said working equipment mounted on said hydraulic-powered machine is loaded, said sensor being mounted on said working equipment to issue a loading weight data signal to said operation automating controller, said loading weight data signal corresponds to a loading weight of said working equipment.

* * * * *